United States Patent [19]

Reichard et al.

[11] 4,286,431

[45] * Sep. 1, 1981

[54] IGNITION SYSTEM FOR COMBUSTIBLE GASES OR LIQUIDS

[75] Inventors: Michel Reichard, Pessac; Georges Krassoulia, Le Bouscat, both of France

[73] Assignee: Societe Europeene de Propulsion, Puteaux, France

[ * ] Notice: The portion of the term of this patent subsequent to Oct. 16, 1996, has been disclaimed.

[21] Appl. No.: 24,676

[22] Filed: Mar. 28, 1979

[30] Foreign Application Priority Data

Mar. 28, 1978 [FR] France ..... 78 08957

[51] Int. Cl.[3] ..... F02C 7/26

[52] U.S. Cl. ..... 60/39.82 E; 60/258

[58] Field of Search ..... 60/39.82 E, 39.82 P, 60/258; 431/133, 269–272

[56] References Cited

U.S. PATENT DOCUMENTS

| | | | |
|---|---|---|---|
| 2,436,305 | 2/1948 | Johnson . | |
| 2,447,758 | 8/1948 | Lubbock et al. | 60/39.82 P |
| 2,518,882 | 8/1950 | Goddard | 60/39.82 E |
| 2,544,419 | 3/1951 | Goddard | 60/258 |
| 2,759,419 | 8/1956 | Hitchens et al. . | |
| 2,972,231 | 2/1961 | Mullen | 60/39.82 E |
| 3,038,302 | 6/1962 | Thackrey | 60/39.82 E |
| 4,110,977 | 9/1978 | Jandl et al. | 60/39.82 E |
| 4,170,941 | 10/1979 | Reichard et al. | 60/39.82 E |

OTHER PUBLICATIONS

Sutton, G. P., "Rocket Propulsion Elements", 4th Edition, John Wiley & Sons, N.Y., 1976, pp. 275 and 299–301.

*Primary Examiner*—Robert E. Garrett

*Attorney, Agent, or Firm*—Fitzpatrick, Cella, Harper & Scinto

[57] ABSTRACT

The invention relates to an ignition system comprising an igniter constituted by a receptacle, an ignition initiator disposed at one end of said receptacle, and a solid charge placed inside the receptacle, the solid charge comprising pyrotechnic compositions and reactive divided metals capable of reacting with one another exothermically, which compositions successively comprise, from the end of the receptacle carrying the initiator, a pyrotechnic ejection composition, a pyrotechnic ignition composition, and reactive divided metals respectively of decreasing activity, wherein the igniter is associated with a combustion chamber containing a fluid constituted by liquid products or formed by mixtures of gases and of liquids or of solid particles, to ensure, by projection of said solid charge within said fluid, the heating or ignition of said fluid.

14 Claims, 6 Drawing Figures

IGNITION SYSTEM FOR COMBUSTIBLE GASES OR LIQUIDS

The present invention relates to an ignition system comprising an igniter according to U.S. Ser. No. 798,016 filed May 18, 1977, constituted by a receptacle, an ignition initiator arranged at one end of said receptacle, and a solid charge placed inside the receptacle, the solid charge comprising pyrotechnic compositions and reactive divided metals capable of reacting together exothermically, which compositions successively comprise, from the end of the receptacle carrying the initiator, a pyrotechnic ejection composition, a pyrotechnic ignition composition and reactive divided metals respectively having decreasing activity.

The structure of such a pyroballistic igniter is described in detail in the above mentioned U.S. Patent application, with reference to FIG. 1 thereof.

In addition, the said U.S. Patent application describes applications of this igniter to the ignition of blocks of combustible powder.

It is an object of the present invention to extend the applications of the igniter described in said copending U.S. Application, whilst modifying the structure of the igniter already described, to a minimum.

The ignition system forming the subject matter of the present invention comprises an igniter of the type described hereinabove, and is characterised in that the igniter is associated with a combustion chamber containing a fluid constituted by gaseous products, liquids or formed by mixtures of gases and liquids or solid particles, to ensure, by projection of said solid charge within said fluid, the heating or ignition of said fluid.

Thus, it has been found that a pyroballistic igniter of the type described in the said U.S. Patent application may be applied not only to the ignition of blocks of combustible powder, but may also serve to heat or ignite fluid contained in a chamber and being either in the static state (at rest) or in the process of flowing. The combustion chamber may thus be closed or be open and have currents of fluid passing therethrough.

According to the invention, a plurality of igniters of the above-mentioned type may be associated with the same combustion chamber.

A number of arrangements of the igniter in the ignition system may be retained. Thus, the igniter may be disposed on a supply pipe of the combustion chamber and project the pyrotechnic products that it generates in the direction of the main flow of the fluid circulating in the pipe.

The igniter may also be disposed on a supply pipe of the combustion chamber to project the pyrotechnic products that it generates into zones of lower speed of flow of the supply pipe in order to give the pyrotechnic products ejected a path different from that of the main flow.

According to an embodiment of the invention, a single igniter of the above-mentioned type is associated with a combustion chamber provided with a plurality of fluid supply pipes, and is oriented so as to project the pyrotechnic products that it generates in the direction of the zone of vortical mixing within the chamber.

In particular, the ignition system according to the invention may comprise an igniter disposed with respect to the wall of the combustion chamber so as to project the pyrotechnic products that it generates in the direction of flow of the fluid to be ignited. In this case, the igniter comprises, for limiting the speed of ejection of the pyrotechnic products, a tube mounted axially in the receptacle in line with the initiator, extending over a part of the portion of the igniter which comprises the pyrotechnic ignition composition, presenting a diameter smaller than said portion of igniter and opening within said pyrotechnic ignition composition, which igniter comprises a proportion of ejection composition reduced to a negligible or zero quantity.

According to a variant embodiment, the ignition system according to the invention may comprise an igniter disposed with respect to the wall of the combustion chamber so as to protect the pyrotechnic products that it generates in an inclined, and preferably transverse direction, with respect to the direction of flow of the fluid to be ignited. In this case, the igniter comprises, to limit the speed of ejection of the pyrotechnic products, a tube mounted axially on the receptacle in line with the initiator and the ejection composition, extending over a small part of the portion of the igniter which comprises the pyrotechnic ignition composition, presenting a smaller diameter than said portion of igniter and opening within the pyrotechnic ignition compound.

According to another variant, an ignition system according to the invention may comprise an igniter of the type mentioned at the beginning which is disposed with respect to the wall of the combustion chamber on the nozzle side thereof, so as to project the pyrotechnic products that it generates in counter-current in the direction opposite the direction of flow of the fluid to be ignited.

The invention will be more readily understood on reading the following description with reference to the accompanying drawings, in which.

Figure 1:
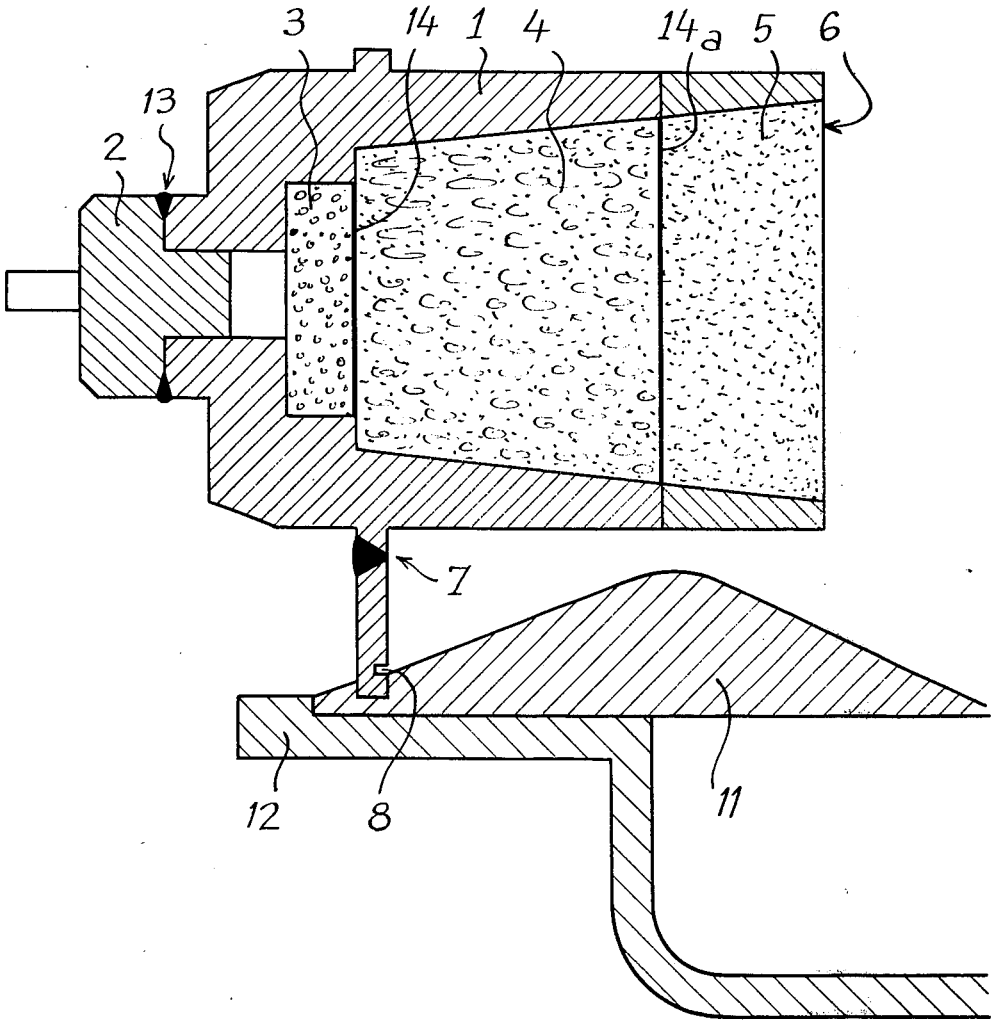
FIG. 1 is a schematic view, in axial section, of an embodiment of an igniter applicable in an ignition system according to the invention.

Referring now to the drawings, FIG. 1 shows an igniter according to the main Patent applicable in the ignition system according to the present invention. This igniter comprises a tubular receptacle 1, for example made of metal, containing pyrotechnic compositions. An initiator 2 is placed on the receptacle 1 at one of its ends, connected for example by soldering by means of electron bombardment (13). The pyrotechnic compositions are arranged in the receptacle in stages, as follows, from the initiator 2:

ejection composition 3 in the form of grains ignition composition 4 in the form of grains and pellets charge 5 composed of reactive powder metal.

The different compositions are separated by metallic membranes 14, 14*a* which have equal or different resistances. A closing obturator 6 of the igniter ensures the tightness on the side opposite the pyrotechnic ignition initiator.

The connecting element 7 comprises a shearing opening 8 calibrated in depth. The element 7 is made fast with the orifice of a blast pipe 11 for escaping gases which is itself fast with the structure 12 or device body or the combustion chamber or a member located near the combustion chamber.

After operation of the initiator 2, the pyrotechnic ejection composition 3 causes the projection of the charge 4 and 5 under the predetermined ballistic conditions and as a function of the masses present and the dimensions of the igniter as to the ratio of the inner diameter and the closure.

The composition 3 may be of the same formulation as composition 4, but its specific surface is very large to fulfil its role of ejection charge.

The ignition composition 4 made up of grains and pellets is ignited during ejection by composition 3 and is projected into the gaseous and/or liquid components to be ignited. Simultaneously, it carries the charge 5 and heats it beyond its melting point, The charge 5 reacts with the products of combustion of the composition 4 in the process of reaction and possibly with the compounds of the gas or gases, liquid or liquids which it encounters.

The proportion and nature of the different pyrotechnic compositions 3,4,5 are defined in the cited U.S. copending Patent Application.

The solid charge 3, 4, 5 placed inside the body 1, which is combustible or preferably incombustible, is intended to be projected into a chamber 12 containing:

either a single liquid or gas or a mixture of liquids or gases, or a liquid-gas mixture.

The products contained in the chamber 12 are either static (at rest) or in the process of flowing. The charge projected may produce either the heating if the products in the enclosure are neutral or ignition if the products are active.

The most current case of use of such a charge 3, 4, 5 is that of the ignition of a mixture of active products (gas+aerosol gas or liquid+gas, or two aerosol liquids).

The ignition system according to the invention is intended to equip combustion chambers in which is/are located one or more gases and/or one or more liquids, such as chambers of ramjets, of liquid-propellant rockets, boilers, and pyrotechnic compositions of varied conformations are arranged with reactive divided metals so that the ignition of the gas, the liquid or the mixture is due to the projection in its midst of grains or pellets in reaction and of a mass of molten metal which, on reacting, possibly with them, takes them to a temperature much higher than the temperature necessary for ignition thereof.

The energetic compositions preferably emit few volatile products so as to be incapable of being of detonating nature. Thus, the transfer of heat from the igniter to the liquid or gaseous mass is ensured by a mass of molten metal, of high calorific capacity. A pyroballistic igniter of the type used in the ignition system according to the invention is particularly capable of igniting the gases, liquids or mixtures in the course of flow, whilst being, itself, placed at a distance from this flow.

FIGS. 2 to 6 show certain arrangements and particular structures of an igniter in an ignition system according to the invention.

A non-limiting example is given hereinbelow of the constitution of a solid charge 3, 4, 5 for an igniter intended for initiating an air-kerosene mixture in a ramjet combustion chamber.

The igniter is in this case placed on any part of the combustion chamber and must ignite the mixture within a period of time compatible with the ballistic propulsion parameters.

The ejector charge weights 2 g and is composed of boron-potassium perchlorate in the form of grains smaller than 400μ. The ignition composition 4 is constituted by 5 g of a mixture of boron-potassium nitrate agglomerated by polyester resin in the form of grains of 500 to 1200μ and 5 g of the same composition in the form of cylindrical pellets having the same height and same diameter (6 mm).

The charge 5 at the front of the igniter is constituted by zirconium in the form of grains smaller than 50μ.

Figure 2:
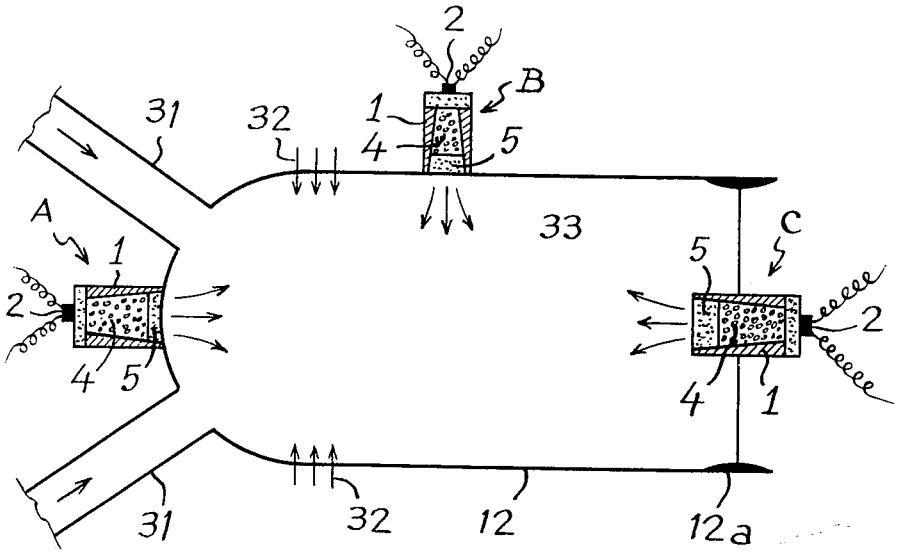
FIG. 2 is a schematic view, in axial section, of a combustion chamber supplied with oxidant and fuel and equipped with one or more igniters according to the invention.

As may be seen in FIG. 2, several igniters may ensure a redundancy at ignition. The internal geometry of an igniter may vary according to the position of the igniter with respect to the combustion chamber.

FIG. 2 shows a combustion chamber 12 provided with a nozzle 12*a* through which the combustion gases escape. Upstream of the chamber 12 are located one or more air inlet conduits 31, and, near these conduits, one or more assemblies 32 for conducting a fuel, such as kerosene. The various conduits 31, 32 open out into the chamber 12 upstream thereof on the side opposite the nozzle 12*a*. An igniter according to the invention may be disposed on the combustion chamber 12 in one of the positions A, B, C shown in FIG. 2. It is possible to use only one of the igniters A, B, C or to use a combination thereof. The number of igniters used is thus not limited.

Figure 3:
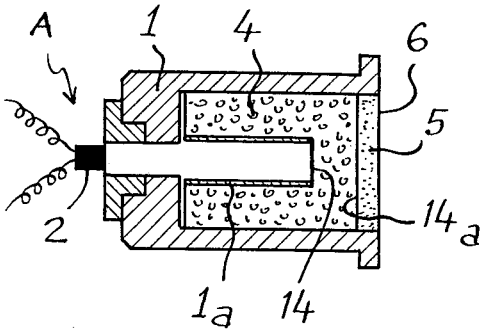
FIG. 3 is a schematic view in axial section of a particular embodiment of the igniter according to the invention, applicable in particular to the igniter A of FIG. 2.
Figure 4:
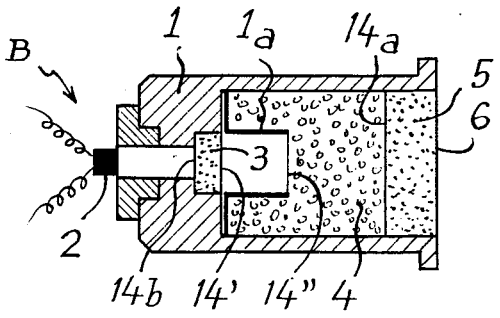
FIG. 4 is a schematic view in axial section of a particular embodiment of the igniter applicable in particular to the igniter B of FIG. 2.
Figure 5:
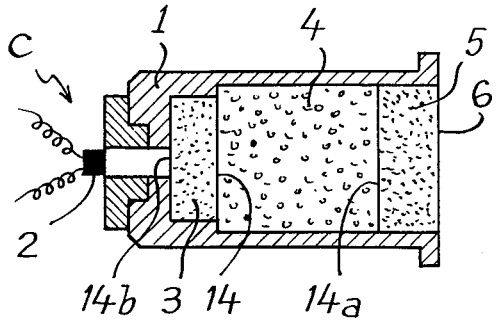
FIG. 5 is a schematic view in axial section of a particular embodiment of the igniter applicable in particular to the igniter C of FIG. 2.

The igniter A is disposed on the side of the combustion chamber 12 where the oxidant inlet and fuel inlet conduits 31 and 32 open. The igniter A is disposed with respect to the wall of the combustion chamber 12 so as to project the pyrotechnic products 4, 5 that it generates in the direction of flow of the fluid to be ignited. In the case of igniter A, the speed of ejection of products 4, 5 must be limited. To this end, the igniter A, as shown in FIG. 3, advantageously comprises only charges 4 and 5, the ejection composition 3 being eliminated. In addition, the igniter A comprises a tube 1*a* of defined diameter, which is disposed axially on the receptacle 1 of the igniter, in line with the initiator 2. The tube 1*a* extends over a part of the position of the igniter which includes the pyrotechnic ignition composition 4, and the tube presents a diameter smaller than the diameter of said portion of the igniter containing the charge 4. The tube 1*a* opens out in the ignition composition 4 at a distance from the membrane 14*a* separating compositions 4 and 5.

The igniter A functions as follows:

The initiator 2 ignites the composition 4 at the outlet of the tube 1*a*. At this instant, only the part of the composition 4 located beyond tube 1*a* is ignited and the combustion of the composition 4 located upstream of the outlet plane of the tube 1*a* propagate slowly and the products in the process of reaction are ejected as the combustion progresses. This configuration of the igniter A makes it possible not to eject the products in combustion too far, makes it possible to decelerate them, to brake them.

Furthermore, the effective duration of functioning of this so-called retro-pyroballistic igniter A is longer than in the case of an igniter without a central tube, as described in the aforesaid copending application. The adjustment of the diameter and the length of the central tube 1*a* enables the duration, stroke and path of the combustion products to be adjusted. The configuration of igniter A is adapted to a position of igniter which discharges in the direction of flow of the fluid to be ignited since it is in this case that it is advantageous to brake the ejection of the products of the igniter in combustion.

The igniter B is disposed with respect to the wall of the combustion chamber 12 so as to project the pyrotechnic products 4, 5 that it generates in an inclined direction, and even transversely with respect to the direction of flow of the fluid to be ignited. The igniter B advantageously has the configuration shown in FIG. 4. In this case, the igniter B is provided with the three pyrotechnic compositions 3, 4, 5, the ejection composition 3 serving to penetrate the main flow of the chamber, but a tube 1*a* is used in order not to eject the ignition products too directly on the face of the chamber 12 which is opposite the igniter B. Thus, the igniter B comprises a tube 1*a* mounted axially on the receptacle 1 in line with the initiator 2 and the ejection composition 3, and extending over a small part of the portion of the igniter which comprises the pyrotechnic ignition composition 4. The tube 1*a* naturally presents a diameter smaller than that of the portion of igniter comprising the charge 4. The tube 1*a* opens out in the ignition composition 4 at a relatively large distance from the membrane 14*a* separating the compositions 4 and 5. The membrane 14 separating the ejection composition 3 and the ignition composition 4 is here constituted by two membranes 14', 14''. The membrane 14' is located immediately at the outlet of the ejection composition 3, whilst the membrane 14'' is located in the outlet plane of the tube 1*a* and retains the ignition composition 4. The ejection composition is also provided with a membrane 14*b* in its upstream part which is separated from the initiator 2. The functioning of igniter B is similar to that of igniter A, in view of the presence of a tube 1*a*, but the ejection of the products 4, 5 is stronger, in view of the presence of the ejection composition 3 and of the relatively limited length of the tube 1*a*.

The igniter C is disposed on the nozzle 12*a* side of the combustion chamber 12, so as to project the pyrotechnic products 4, 5 that it generates in counter-current, in the direction opposite the direction of flow of the fluid to be ignited. In the case of the igniter C, the main flow must be overcome and the products 4, 5 must be driven as far as possible towards the front bottom of the combustion chamber 12. The igniter C thus advantageously presents the configuration shown in FIG. 5. The igniter C of FIG. 5 does not comprise a tube 1*a* and is in accordance with the structure of the igniter described in the above-identified copending application, or with reference to FIG. 1 of the present application. However, the igniter C has a receptacle 1 of which the inner shape is only very slightly flared at its outlet, or is even cylindrical, so as to allow a more precise orientation of the path of the ignition composition ejected.

The elements preforming the same role in the case of FIGS. 1 to 6 bear identical references.

Figure 6:
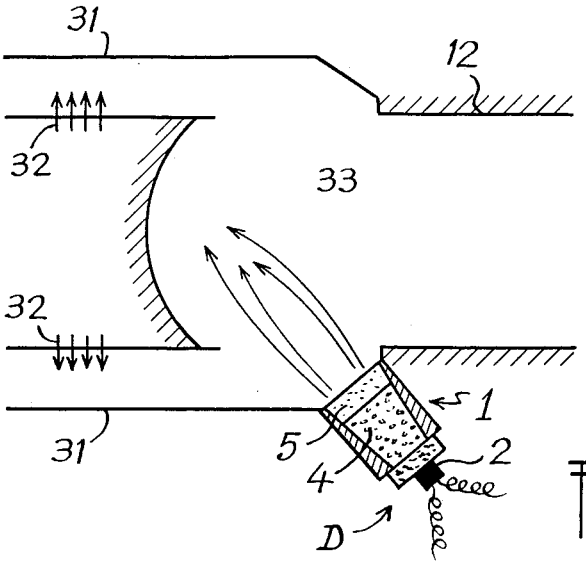
FIG. 6 is a schematic view showing an igniter mounted on the conduit for admission of a mixture of oxidant-fuel at the inlet of a combustion chamber.

FIG. 6 shows an ignition system in which an igniter, such as the one described with reference to FIG. 1, is intended for igniting a combustion chamber 12 in which a mixture of air and fuel is made, said fuel being of liquid, solid or gaseous origin.

The position of the igniter D of FIG. 6 on conduits 31, 32 for supplying the air-fuel mixture, makes it possible to orient the direction towards which the composition 4, 5 is ejected, particularly towards the front bottom of the chamber 12. The products of combustion 4, 5 suddenly driven out, pass through the flow in the supply conduits 31 of the chamber and penetrate in the vortical mixture inside (33) the chamber 12.

According to the number of conduits 31 for supplying the mixture, it is possible to place an igniter D on each conduit, or one igniter D only whatever the number of conduits 31. The conical or cylindrical internal shape of the receptacle 1 also makes it possible, in all cases, to orient more or less the path of the ignition composition ejected.

What is claimed is:

1. An ignition system comprising an igniter, constituted by a receptacle, an ignition initiator disposed at one end of said receptacle, and a solid charge placed inside the receptacle, the solid charge comprising pyrotechnic compositions and reactive divided metals capable of reacting with one another exothermically, said compositions successively comprising, from the end of the receptacle carrying the initiator, a pyrotechnic ejection composition, a pyrotechnic ignition composition, and reactive divided metals respectively of decreasing activity, wherein;

the igniter is associated with a combustion chamber containing a fluid constituted by liquid products or formed by mixtures of gases and liquids or solid particles, to ensure, by projection of said solid charge within said fluid, the heating or ignition of said fluid.

2. The ignition system of claim 1, wherein the combustion chamber is closed.

3. The ignition system of claim 1, wherein the combustion chamber is open and has currents of said fluid passing therethrough.

4. The ignition system of claim 1, comprising a plurality of igniters of the same type, associated with the same combustion chamber.

5. The ignition system of claim 1, wherein the igniter is disposed on a supply conduit of the combustion chamber and projects the pyrotechnic products that it generates in the direction of main flow of the fluid circulating in said conduit.

6. The ignition system of claim 1, wherein the igniter is disposed on a supply conduit of the combustion chamber and projects the pyrotechnic products that it generates in zones of lower speed of flow of the supply conduit to give the pyrotechnic products ejected a different path from that of the main flow.

7. The ignition system of claim 1, wherein it comprises a single igniter associated with a combustion chamber provided with a plurality of fluid supply conduits, and oriented so as to project the pyrotechnic products that it generates in the direction of the zone of vortical mixture within the chamber.

8. The ignition system of claim 1, wherein the igniter is disposed with respect to the wall of the combustion chamber so as to project the pyrotechnic products that it generates in the direction of flow of the fluid to be ignited, said igniter comprises, for limiting the speed of ejection of said pyrotechnic products, a tube mounted axially in the receptacle in line with the initiator, extending over a part of the portion of the igniter comprising the pyrotechnic ignition composition, having a diameter smaller than said portion of igniter and opening within said pyrotechnic ignition composition, and said igniter comprises a proportion of ejection composition reduced to a negligible or zero quantity.

9. The ignition system of claim 1, wherein the igniter is disposed with respect to the wall of the combustion chamber so as to project the pyrotechnic products that it generates in an inclined and preferably transverse direction with respect to the direction of flow of the fluid to be ignited and said igniter comprises, to limit the speed of ejection of said pyrotechnic products a tube mounted axially in the receptacle in line with the initiator and the ejection composition, extending over a small part of the portion of the igniter comprising the pyrotechnic ignition composition, having a diameter smaller than said portion of igniter and opening within said pyrotechnic ignition composition.

10. The ignition system of claim 1, wherein the igniter is disposed with respect to the wall of the combustion chamber, on the nozzle side of said chamber, so as to project the pyrotechnic products that it generate in counter-current in the direction opposite the direction of flow of the fluid to be ignited.

11. An ignition system comprising a plurality of igniters, each constituted by a receptacle, an ignition initiator disposed at one end of said receptacle, and a solid charge placed inside the receptacle, the solid charge comprising pyrotechnic compositions and reactive divided metals capable of reacting with one another exothermically, said compositions successively comprising, from the end of the receptacle carrying the initiator, a pyrotechnic ejection composition, a pyrotechnic ignition composition, and reactive divided metals respectively of decreasing activity, wherein said igniters are associated with a common combustion chamber containing a fluid constituted by liquid products or formed by mixtures of gases and liquids or solid particles, to ensure, by projection of said solid charge within said fluid, the heating or ignition of said fluid and wherein at least one igniter is disposed on a supply conduit of the combustion chamber and projects the pyrotechnic products that it generates substantially in the direction of main flow of the fluid circulating in said conduit.

12. The ignition system of claim 11, wherein at least one igniter is disposed on a supply conduit of the combustion chamber and projects the pyrotechnic products that it generates in zones of lower speed of flow of the supply conduit to give the pyrotechnic products ejected a different path from that of the main flow.

13. The ignition system of claim 11, wherein at least one igniter is disposed with respect to the wall of the combustion chamber so as to project the pyrotechnic products that it generates in an inclined and preferably transverse direction with respect to the direction of flow of the liquid to be ignited, and said at least one igniter comprises, to limit the speed of ejection of said pyrotechnic products, a tube mounted axially in the receptacle in line with the initiator and the ejection composition, extending over a small part of the portion of said at least one igniter comprising the pyrotechnic ignition composition, having a diameter smaller than said portion of said at least one igniter and opening within said pyrotechnic ignition composition.

14. The ignition system of claim 11, wherein at least one igniter is disposed with respect to the wall of the combustion chamber, on the nozzle side of said chamber, so as to project the pyrotechnic products that it generates in counter-current in the direction opposite the direction of flow of the fluid to be ignited.

* * * * *

UNITED STATES PATENT AND TRADEMARK OFFICE

CERTIFICATE OF CORRECTION

PATENT NO. : 4,286,431

DATED : September 1, 1981

INVENTOR(S) : MICHEL RIECHARD, et al.

It is certified that error appears in the above—identified patent and that said Letters Patent is hereby corrected as shown below:

Column 2, line 13, "protect" should be --project--.

Column 4, line 51, "position" should be --portion--.

Signed and Sealed this

*Third* Day of *November 1981*

[SEAL]

*Attest:*

GERALD J. MOSSINGHOFF

*Attesting Officer* *Commissioner of Patents and Trademarks*